United States Patent [19]

McMorrow et al.

[11] Patent Number: 4,496,256

[45] Date of Patent: Jan. 29, 1985

[54] IMPACT PRINTING APPARATUS

[75] Inventors: Harold L. McMorrow, Kettering; Theodore T. Trzaska, Dayton, both of Ohio

[73] Assignee: NCR Corporation, Dayton, Ohio

[21] Appl. No.: 480,050

[22] Filed: Mar. 29, 1983

[51] Int. Cl.[3] ..... B41J 35/26

[52] U.S. Cl. ..... 400/248; 400/59

[58] Field of Search ..... 400/55, 58, 59, 247, 400/248, 649, 713; 24/101 R, 101 B

[56] References Cited

U.S. PATENT DOCUMENTS

| | | | |
|---|---|---|---|
| 3,750,792 | 8/1973 | Liles | 197/1 R |
| 3,929,214 | 12/1975 | Hebert | 197/1 R |
| 3,941,231 | 3/1976 | Matuck et al. | 400/248 |
| 4,024,940 | 5/1977 | Hendrischk et al. | 197/1 R |
| 4,090,600 | 5/1978 | Biedermann | 400/213 |
| 4,165,188 | 8/1979 | Rempel | 400/124 |
| 4,197,023 | 4/1980 | DeBoo et al. | 400/578 |
| 4,304,496 | 12/1981 | Vidwans | 400/248 |
| 4,325,645 | 4/1982 | Miyajima et al. | 400/248 |
| 4,383,775 | 5/1983 | Trammell et al. | 400/208 |
| 4,408,912 | 10/1983 | Yonkers | 400/208 |
| 4,410,291 | 10/1983 | Speraggi | 400/247 |
| 4,422,785 | 12/1983 | Shore | 400/247 |

FOREIGN PATENT DOCUMENTS

| | | | |
|---|---|---|---|
| 56-92082 | 7/1981 | Japan | 400/59 |
| 57-152976 | 9/1982 | Japan | 400/58 |
| 1358507 | 7/1974 | United Kingdom . | |

OTHER PUBLICATIONS

D. F. Colglazier et al., "Print Head Control Apparatus"; *IBM Technical Disclosure Bulletin;* vol. 17, No. 4, pp. 1186-1187; Sep. 1974.

R. G. Boyatt, Jr.; "Peripheral Print Shield"; *IBM Technical Disclosure Bulletin;* vol. 15, No. 11, pp. 3398-3399; Apr. 1973.

*Primary Examiner*—Edgar S. Burr

*Assistant Examiner*—David A. Wiecking

*Attorney, Agent, or Firm*—Albert L. Sessler, Jr.

[57] ABSTRACT

A resilient ribbon mask for an impact printing apparatus which includes a print head is mounted for sliding movement on a frame connected to the print head. The frame and mask are angled away at either side of the print head from the surface of the platen along which the print head travels in a line printing operation. A slot in the mask for allowing passage of printing elements therethrough is oriented with its long dimension parallel to the direction of print head travel, and extends into the angled portions of the mask on each side of the print head so that the slot ends do not engage the record media being printed upon. The ribbon mask is held in close proximity to the print head during printing operations, but is permitted to spring away from the print head at the end of a line being printed, in order to facilitate ribbon changing and record media insertion and removal.

9 Claims, 6 Drawing Figures

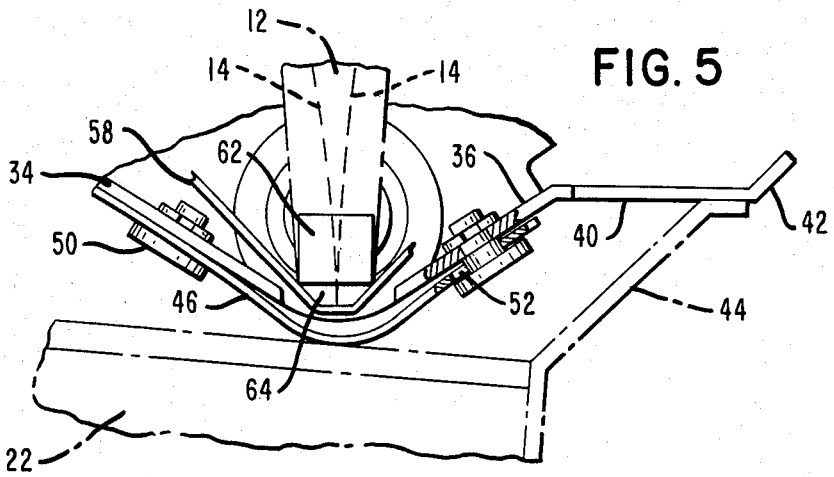
FIG. 5
FIG. 6
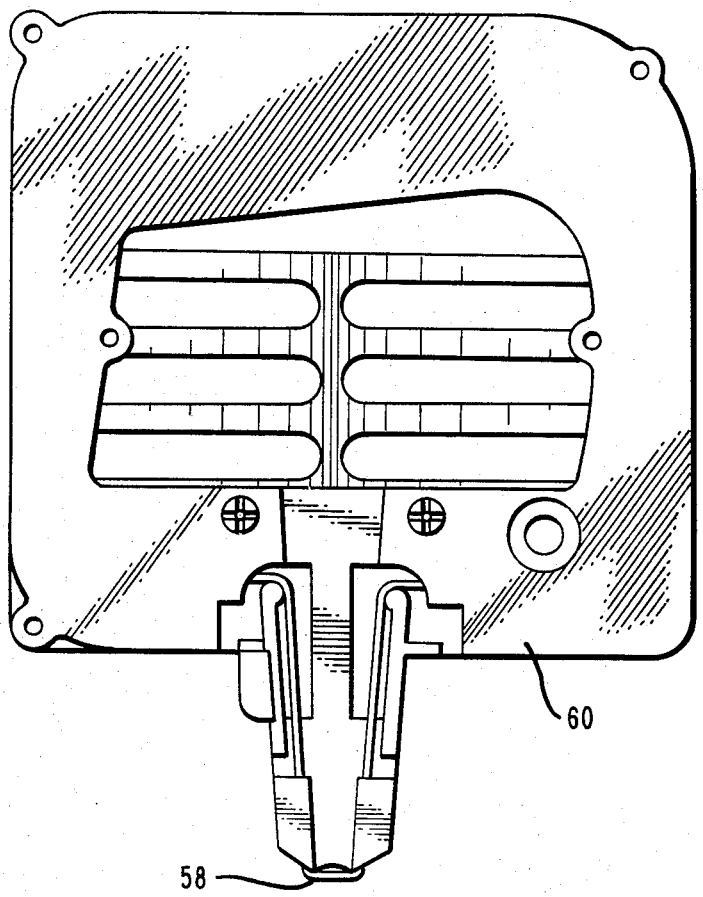

IMPACT PRINTING APPARATUS

BACKGROUND OF THE INVENTION

Problems of smudging and record media damage in the nature of tearing and snagging have been experienced in connection with the use of impact printers, especially that type of impact printer which employs reciprocating movement of one or more relatively long, thin wire-like printing elements, sometimes called dot matrix printers. This is due at least in part to the fact that such printing elements move only a very short distance, usually not more than 0.015 inches, in a printing excursion, and consequently the medium to be printed upon must be positioned in very close proximity to the printing elements and the ink ribbon.

The smudging and record media damage problems have been recognized in the past, and proposed solutions have included the use of ribbon masks interposed between the ribbon and the record media being printed upon. In one arrangement, a flexible mask has been added to the cassette which holds the ink ribbon. Another solution involves the use of a ribbon mask which forms part of the structure of the printing apparatus, such as is shown in U.S. Pat. No. 4,165,188. These arrangements would appear to be useful primarily in the feeding of a platen means for supporting record media for printing; printing means comprising a plurality of impact printing elements and a frame for mounting said printing elements for reciprocating printing movement; means for maintaining a predetermined distance between said platen means and said printing means during a printing operation; ribbon guide means secured to said printing means for guiding a printing ribbon into cooperative relation between the ends of said print elements and the platen means on which record media may be positioned for printing; ribbon mask support means secured to said printing means; ribbon mask means secured adjacent one end thereof to said ribbon mask support means and slidingly coupled to said support means adjacent the other end of said ribbon mask means, said ribbon mask means being positioned to receive the printing ribbon between said mask means and the ribbon guide means, and having an aperture therein to accommodate movement therethrough by the printing elements; a cam surface on the ribbon mask support means comprising an angled extension thereof; and a cam surface on the platen means comprising a planar element secured at an end of the platen means and disposed at an angle to the reciprocating direction of movement of the platen means for cooperative engagement with the angled extension of the ribbon mask support means to increase the predetermined distance between the printing means and the platen means at the end of a printing line, whereby printing ribbon insertion is facilitated.

In order to overcome the conditions of smudging of record media by ink ribbons and document damage by tearing at a thickness transition, a ribbon mask must possess sufficient stiffness to move over the media thickness transition without collapsing against the ribbon and thereby causing undesirable drag and loading effects on the ribbon drive mechanism. At the same time, the relatively small clearance between the print head and the record media must not be exceeded, so that proper printing can continue to take place. Means must be provided for adequate clearance between the print head and the ink ribbon mask when necessary to enable ribbon insertion and removal. In addition, the opening in the mask through which the print elements impact the media must be of the proper configuration and must not present an edge to the record media which would result in snagging and tearing.

SUMMARY OF THE INVENTION

This invention relates to impact printing apparatus, and more particularly relates to means for eliminating smudging and damage to record media in impact-type printers.

In accordance with one embodiment of the invention, a printing apparatus comprises printing means including at least one printing element and also including ribbon mask support means; and ribbon mask means secured adjacent one end thereof to said ribbon mask suppprt means and slidingly coupled to said ribbon mask support means adjacent the other end of said ribbon mask means, said ribbon mask means being positioned to receive a printing ribbon between said mask means and said printing means, and having an aperture therein to accommodate printing action by the printing element through said ribbon mask means.

It is accordingly an object of the present invention to provide means for preventing ribbon smudging and record media damage in an impact printing apparatus.

Another object is to provide a ribbon masking device in a printing apparatus in order to prevent smudging and damage to the record media being printed upon.

A further object is to provide a resilient slidably mounted ribbon masking device in a printing apparatus in order to prevent smudging and damage to the record media being printed upon, while at the same time enabling adequate clearances for record media insertion and ribbon changing.

A further object is to provide a ribbon masking device in a printing apparatus having a printing element aperture in said masking device which is configured to avoid slot edge contact with the record media being printed upon, thereby to avoid snagging or tearing of the record media.

With these and other objects, which will become apparent from the following description, in view, the invention includes certain novel features of construction and combinations of parts, a preferred form or embodiment of which is hereinafter described with reference to the drawings which accompany and form a part of this specification.

BRIEF DESCRIPTION OF THE DRAWINGS

FIG. 5 is a view similar to FIG. 2, showing the ribbon mask in an extended position.

FIG. 6 is an elevation view of an ink ribbon cassette suitable for use with the printing apparatus of FIG. 1, showing a portion of the ribbon path.

DETAILED DESCRIPTION OF THE INVENTION

Figure 1:
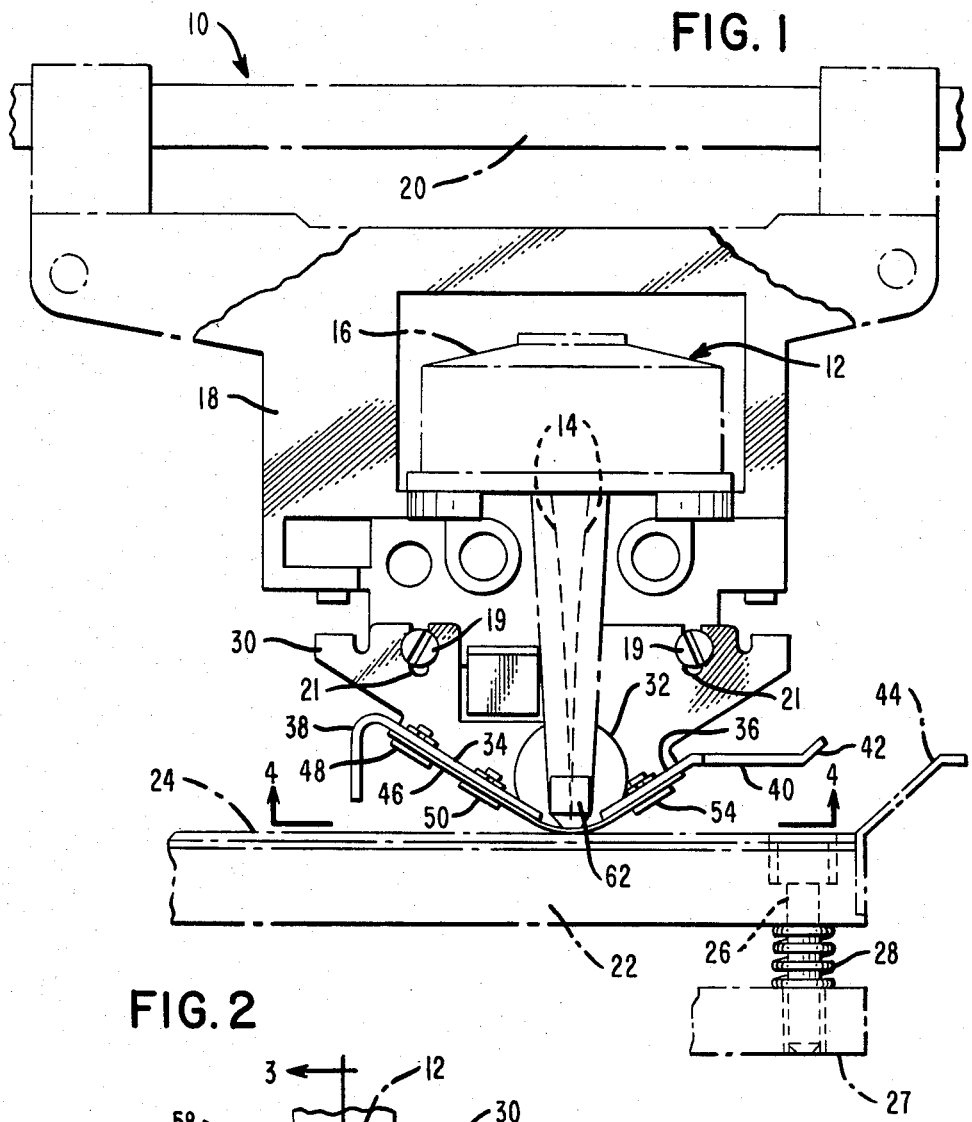
FIG. 1 is an elevation view of the printing apparatus of the present invention.

Referring now particularly to FIG. 1, shown therein is a printing apparatus 10 which includes a print head 12, comprising a plurality of print wires 14 shown in phantom lines, which extend from and are driven by driving means shown generally at 16, which may comprise a plurality of solenoids (not shown), one for each print wire 14. This portion of the print head 12 is generally conventional, and may, for example, take the form shown in U.S. Pat. No. 3,929,214, issued Dec. 30, 1975, inventor Donald G. Hebert.

The print head 12 is mounted in a frame 18 which is supported for sliding reciprocating movement on a bar 20 secured to the machine framework of the printing apparatus 10. The bar 20 is parallel to the longtudinal axis of a platen 22 with which the print head 12 cooperates to effect printing upon record media 24 positioned on the platen 22. In the illustrated embodiment of the invention, the platen 22 is flexibly mounted in the printing apparatus framework, by means such as a fastener 26 which extends into a frame member 27 and an associated spring 28, and can be urged downwardly from the position in which it is shown in FIG. 1 for purposes of record media insertion and ink ribbon replacement, as will subsequently be described in greater detail. It will be obvious to one skilled in the art that, if desired, the platen 22 could be rigidly mounted, and the print head 12 could be resiliently mounted, so as to provide for a selective increase in the normal distance between the print head and the platen.

A guide plate 30 is adjustably secured to the frame 18 by means of screws 19 cooperating with slots 21 in the plate 30. On the plate 30 is provided a guide means such as a roller 32 which rolls along the surface of the record media 24 positioned on the platen 22 and thereby maintains a constant distance, consistent with the requirements of the printing wires 14, between the print head 12 and the record media 24, regardless of changes in the thickness of said record media. The guide roller 32 may be rotatably mounted on a shaft 29, and be provided with a rubber periphery 31, so as to avoid undesirable abrasion of the record media 24.

The guide plate 30 also includes two arms 34 and 36 formed at right angles to the remainder of the plate 30. It will be seen that the arms 34 and 36 are each formed so that their surfaces are at an angle to the path of movement of the print head 12 along the platen 22, with said arms being closest to the platen 22 adjacent to the print head 12 and diverging from said platen 22 as the distance from the print head 12 increases.

An extension 38 of the arm 34 is bent downwardly for engagement with a flat elongated spring (not shown) which may be employed to retain the record media closely against the platen 22.

An extension 40 of the arm 36 is bent to extend parallel with the platen 22 and has at its end a cam surface 42, which is bent upwardly to engage a cooperating cam surface 44 attached to the end of the platen 22. It will be seen that as the print head 12 is moved to the right during a printing operation, the engagement of the cam surfaces 42 and 44 causes the right end of the platen 22 to be shifted downwardly as viewed in FIG. 1, until the upper end of the surface 44 engages the surface 40, thus increasing the distance between the platen 22 and the print head 12 to facilitate insertion of record media 24 into the printing apparatus 10. This downward movement of the platen 22 also facilitates ribbon replacement, as will subsequently be described.

A ribbon mask 46 is fixed to the arm 34 of the plate 30 by some appropriate means, such as the headed studs or rivets 48, 50. Near its other end, the mask 46 is slotted as shown at 52, to receive a headed shoulder stud 54, having a shoulder of greater width than the thickness of the mask 46, to permit slidable movement of the mask 46 with respect to the arm 36 of the plate 30. The ribbon mask 46 is made from some suitable stiff, resilient material, such as stainless steel of type SST AISI 301 or 302. This provides sufficient stiffness to prevent undesired deformation of the mask, while at the same time permitting the mask to move under pressure from the position in which it is shown in FIG. 5 to the position in which it is shown in FIGS. 1 and 2 when the print head is in its normal operative relationship with the platen 22 for printing on the record media 24.

Figure 4:
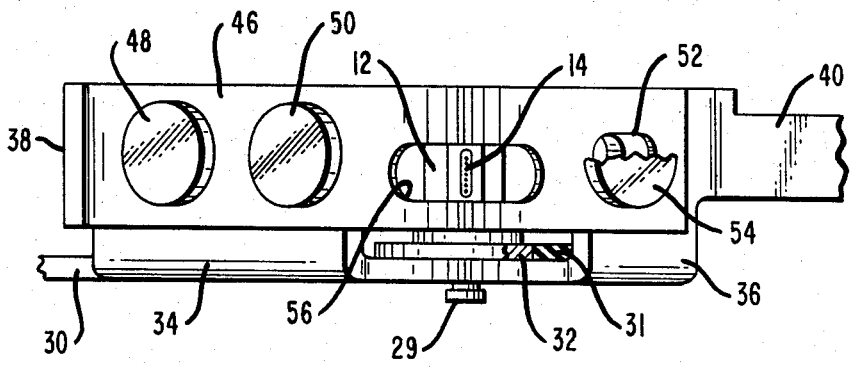
FIG. 4 is a fragmentary sectional view taken along line 4—4 of FIG. 1.

As is best shown in FIG. 4, the mask 46 is provided with an elongated slot 56 to permit movement of the print wires 14 therethrough for printing on the record media 24. It will be seen that the slot 56 has its long dimension perpendicular to the aligned print wires 14 and parallel to the direction of movement of the print head 12 along the platen 22. The slot 56 is sufficiently elongated that each end of said slot is positioned up on one of the angled portions of the mask 46, and out of engagement with the record media 24 during printing operations. This prevents snagging or tearing of the record media 24 by the ends of the slot 56.

Figure 2:
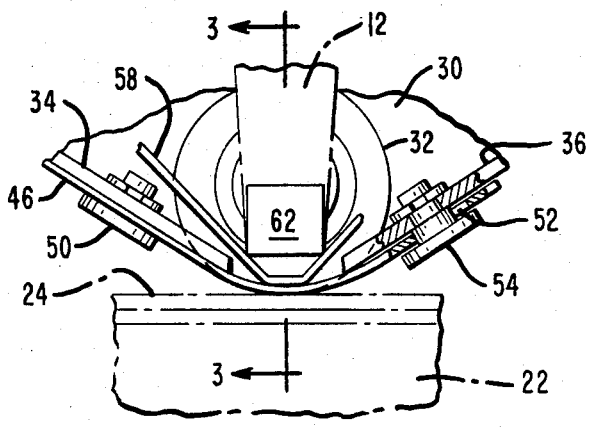
FIG. 2 is a fragmentary enlarged view of the end portion of the printing apparatus of FIG. 1, showing in greater detail the relationship of the ribbon guide, the ribbon mask support plate, the ribbon mask, the ribbon, the platen, and the distance guide.
Figure 3:
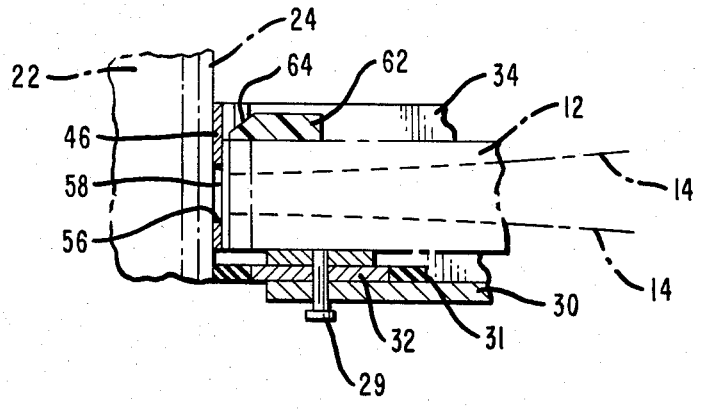
FIG. 3 is a fragmentary sectional view taken along line 3—3 of FIG. 2.

As is best shown in FIGS. 2, 3 and 5, an ink ribbon 58 is provided for the printing apparatus 10 and is positioned between the print head 12 and the ribbon mask 46. This ink ribbon may conveniently be contained in a conventional ink ribbon cassette 60, such as is shown in FIG. 6. The cassette 60 contains both supply and take-up ribbon means, and the ribbon 58 moves from the supply means to the take-up means, traversing the printing position between the print head 12 and the mask 46 as it does so. A ribbon guide 62 is secured to the print head 12 and contains an angled surface 64 which facilitates insertion of the ribbon between the print head 12 and the mask 46.

It will be seen that with the printing apparatus in the normal printing position in which it is shown in FIGS. 1 and 2, the space between the print head 12 and the mask 46 is very limited, so that ribbon insertion would be extremely difficult. This difficulty is overcome by traversing the print head 12 to the end of the platen 22 at which time the cam surfaces 40 and 44 engage, shifting the platen 22 downwardly as shown in FIG. 5. This movement of the platen 22 away from the print head 12 permits the natural resilience of the mask 46 to cause said mask to be bowed downwardly, until the upper end of the slot 52 engages the headed stud 54. An increased space is thus provided between the mask 46 and the print head 12 which facilitates placement of the ribbon 58 therebetween. The angled surface 64 on the guide 62 further facilitates this operation.

While the form of the invention shown and described herein is admirably adapted to fulfill the objects primarily stated, it is to be understood that it is not intended to confine the invention to the form or embodiment disclosed herein, for it is susceptible of embodiment in various other forms within the scope of the appended claims.

We claim:

1. Printing apparatus comprising:

platen means for supporting record media for printing:

printing means comprising a plurality of impact printing elements and a frame for mounting said printing elements for reciprocating printing movement;

means for maintaining a predetermined distance between said platen means and said printing means during a printing operation;

ribbon guide means secured to said printing means for guiding a printing ribbon into cooperative relation between the ends of said print elements and the platen means on which record media may be positioned for printing;

ribbon mask support means secured to said printing means;

ribbon mask means secured adjacent one end thereof to said ribbon mask support means and slidingly coupled to said support means adjacent the other end of said ribbon mask means, said ribbon mask means being positioned to receive the printing ribbon between said mask means and the ribbon guide means, and having an aperture therein to accommodate movement therethrough by the printing elements;

a cam surface on the ribbon mask support means comprising an angled extension thereof; and a cam surface on the platen means comprising a planar element secured at an end of the platen means and disposed at an angle to the reciprocating direction of movement of the platen means for cooperative engagement with the angled extension of the ribbon mask support means to increase the predetermined distance between the printing means and the platen means at the end of a printing line, whereby printing ribbon insertion is facilitated.

2. The printing apparatus of claim 1 in which the ribbon mask support means comprises an arm on each side of the printing means angled away from the surface of the platen means and in which the ribbon mask means is correspondingly angled away from the printing means on each side of the printing means by reason of its connection adjacent each end to the ribbon mask support means.

3. The printing apparatus of claim 2 in which the aperture in the ribbon mask means comprises a slot having a long dimension in a direction parallel to the path of movement of the printing means, and with the slot extending on each side into the angled portions of the ribbon mask means.

4. The printing apparatus of claim 1 in which the ribbon mask means is stainless steel.

5. The printing apparatus of claim 1 in which the ribbon guide means includes an angled surface to facilitate insertion of the printing ribbon.

6. The printing apparatus of claim 1 in which the printing means is mounted for sliding linear movement in said printing apparatus and in which the platen means is resiliently mounted in a record media supporting position.

7. The printing apparatus of claim 1, in which the ribbon mask means is resilient and, when not positioned in printing relation to the platen means, is retained on the ribbon mask support means in a position in which it is spaced away from said printing elements by its resiliency to facilitate ink ribbon insertion and replacement.

8. The printing apparatus of claim 7 in which the predetermined distance between said platen means and said printing means during a printing operation is such that the ribbon mask means is biased against its resiliency to decrease the distance between the ribbon guide means and the ribbon mask means.

9. The printing apparatus of claim 1 in which the sliding coupling of the ribbon mask means to the ribbon mask support means comprises a slot in the ribbon mask means in which is received a headed shoulder stud fixed to the ribbon mask support means.

* * * * *